US011071436B2

(12) United States Patent
Poyner et al.

(10) Patent No.: US 11,071,436 B2
(45) Date of Patent: Jul. 27, 2021

(54) DISHWASHER SPRAY FILL

(71) Applicant: ELECTROLUX HOME PRODUCTS, INC., Charlotte, NC (US)

(72) Inventors: Dennis A. Poyner, Kinston, NC (US); Mark D. Montgomery, Greenville, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 16/413,826

(22) Filed: May 16, 2019

(65) Prior Publication Data

US 2019/0269296 A1 Sep. 5, 2019

Related U.S. Application Data

(62) Division of application No. 14/886,667, filed on Oct. 19, 2015, now Pat. No. 10,335,012.

(51) Int. Cl.

| | |
|---|---|
| ***A47L 15/42*** | (2006.01) |
| ***A47L 15/00*** | (2006.01) |
| ***A47L 15/16*** | (2006.01) |

(52) U.S. Cl.

CPC ..... *A47L 15/4217* (2013.01); *A47L 15/0023* (2013.01); *A47L 15/16* (2013.01); *A47L 15/4204* (2013.01); *A47L 15/4208* (2013.01); *A47L 15/4278* (2013.01); *A47L 2401/09* (2013.01); *A47L 2401/12* (2013.01); *A47L 2501/01* (2013.01); *A47L 2501/03* (2013.01)

(58) Field of Classification Search

None

See application file for complete search history.

(56) References Cited

U.S. PATENT DOCUMENTS

| | | | |
|---|---|---|---|
| 1,949,814 | A | 3/1930 | Silvlus |
| 4,277,290 | A | 7/1981 | Andrews et al. |
| 5,282,901 | A | 2/1994 | Reinhard |
| 5,462,606 | A | 10/1995 | Burns |
| 6,422,180 | B1 | 7/2002 | Yiu |

(Continued)

FOREIGN PATENT DOCUMENTS

| | | |
|---|---|---|
| DE | 1857490 U | 8/1962 |
| DE | 20118137 U1 | 3/2003 |

(Continued)

*Primary Examiner* — Mikhail Kornakov
*Assistant Examiner* — Ryan L Coleman
(74) *Attorney, Agent, or Firm* — RatnerPrestia

(57) ABSTRACT

Provided are systems, methods, and apparatus for spraying water in a dishwasher. A dishwasher may include a wash chamber and at least one dish rack. The dishwasher may include a water inlet selectively connected to a dish spray device, which may connect a dish spray conduit with the wash chamber. The dish spray device may be oriented towards the at least one dish rack, such that the spray device may be configured to direct water onto the dishes for washing. The water inlet may be selectively connected to a fill device, which may connect the fill conduit with the wash chamber. The fill device may be configured to provide water to the circulation assembly without impinging the at least one dish rack. The one or more valves may selectively direct water from the water inlet to one or both of the dish spray device and the fill device.

19 Claims, 9 Drawing Sheets

(56) References Cited

U.S. PATENT DOCUMENTS

| | | | |
|---|---|---|---|
| 6,821,354 | B2 | 11/2004 | McKee et al. |
| 7,104,269 | B2 | 9/2006 | McKee et al. |
| 7,332,041 | B2 | 2/2008 | McKee et al. |
| 7,789,968 | B2 | 9/2010 | Elick et al. |
| 7,988,789 | B2 | 8/2011 | Elick et al. |
| 8,409,362 | B2 | 4/2013 | Elick et al. |
| 2003/0213503 | A1 | 11/2003 | Price et al. |
| 2003/0213505 | A1 | 11/2003 | Price et al. |
| 2004/0003830 | A1 | 1/2004 | Elick et al. |
| 2004/0163690 | A1 | 8/2004 | Kim |
| 2006/0081272 | A1 | 4/2006 | Jung |
| 2006/0096618 | A1 | 5/2006 | Price et al. |
| 2006/0237036 | A1 | 10/2006 | Picardat et al. |
| 2007/0235063 | A1 | 10/2007 | Lee et al. |
| 2007/0261723 | A1 | 11/2007 | Price et al. |
| 2009/0139544 | A1 | 6/2009 | Ahn et al. |
| 2010/0071725 | A1* | 3/2010 | Peukert ..... A47L 15/0005 134/25.2 |
| 2011/0036435 | A1 | 2/2011 | Haltmayer et al. |
| 2012/0043400 | A1* | 2/2012 | Heyse ..... B05B 1/042 239/567 |
| 2012/0111376 | A1 | 5/2012 | Worrasangasilpa et al. |
| 2012/0144878 | A1 | 6/2012 | Acharya et al. |
| 2012/0145194 | A1 | 6/2012 | Jerg et al. |
| 2012/0186609 | A1 | 7/2012 | Haltmayer et al. |
| 2012/0312337 | A1* | 12/2012 | Boyer ..... A47L 15/0039 134/111 |
| 2013/0139854 | A1 | 6/2013 | Lee et al. |
| 2013/0319458 | A1 | 12/2013 | Lim et al. |
| 2014/0007767 | A1 | 1/2014 | Grunewald |
| 2014/0069462 | A1 | 3/2014 | Becker et al. |
| 2014/0158163 | A1 | 6/2014 | Montgomery et al. |
| 2014/0261576 | A1 | 9/2014 | Lee et al. |
| 2014/0318585 | A1 | 10/2014 | Kim et al. |

FOREIGN PATENT DOCUMENTS

| | | | |
|---|---|---|---|
| DE | 10248268 | | 4/2004 |
| DE | 102009045547 | A1 | 4/2011 |
| DE | 102010001344 | A1 | 8/2011 |
| DE | 102012209418 | A1 | 12/2013 |
| DE | 102013204003 | A1 | 9/2014 |
| EP | 0727179 | | 8/1996 |
| EP | 1411164 | | 4/2004 |
| EP | 2309052 | A1 | 4/2011 |
| JP | H04279135 | A | 10/1992 |
| JP | H04279138 | A | 10/1992 |
| WO | WO-2015/167574 | | 11/2015 |

* cited by examiner

DISHWASHER SPRAY FILL

CROSS-REFERENCE TO RELATED APPLICATIONS

This application is a divisional application of U.S. application Ser. No. 14/886,667, filed Oct. 19, 2015, the content of which is incorporated herein in its entirety by reference.

FIELD OF THE INVENTION

Embodiments of the present invention relate generally to dishwashers and, more particularly, to fill systems for dishwashers and associated methods for delivering water to a wash chamber of a domestic appliance.

BACKGROUND OF THE INVENTION

Prior to beginning a wash cycle, conventional dishwashers fill with washing liquid up to a predetermined level. Once the liquid reaches the predetermined level, a circulation pump delivers the liquid to one or more spray arms which spray the washing liquid onto articles within the wash chamber for cleaning. Typically, the dishwasher only applies washing liquid to the dishes after the dishwasher is filled because the circulation pump requires a minimum amount of water to operate efficiently. However, this filling process often takes a substantial amount of time relative to the overall length of the dishwashing cycle. Moreover, the dishwasher must typically be filled multiple times during the course of the dishwashing cycle, which further delays the washing process.

Applicant has identified a number of additional deficiencies and problems associated with conventional dishwasher filling devices and other associated systems and methods. Through applied effort, ingenuity, and innovation, many of these identified problems have been solved by developing solutions that are included in embodiments of the present invention, many examples of which are described in detail herein.

BRIEF SUMMARY OF THE INVENTION

Generally, some embodiments provided herein include methods and apparatus for filling dishwashers and other domestic appliances. In some embodiments, a dishwasher may be provided comprising a wash chamber comprising a sump disposed proximate a lower end of the wash chamber and a circulation assembly connected to the sump; at least one dish rack positionable within the wash chamber of the dishwasher, wherein the at least one dish rack is configured to receive dishes for washing; a water inlet configured to connect the dishwasher to a water source; a first dish spray device in the wash chamber oriented towards the at least one dish rack for spraying water onto the dishes; a dish spray conduit fluidly connecting the water inlet to the first dish spray device for supplying water from the water inlet to the first spray device; a fill device in the wash chamber configured to provide water to the wash chamber without impinging the dishes; a fill conduit fluidly connecting the water inlet to the fill device for supplying water from the water inlet to the fill device; and one or more valves configured for selectively fluidly connecting the water inlet to one or both of the dish spray conduit and the fill conduit upstream of the wash chamber and thereby directing water from the water inlet to one or both of the first dish spray device and the fill device.

In some embodiments, the fill conduit may include a pressure regulator configured to reduce the pressure of the water from the water inlet, such that the water may have a lower pressure at the at least one fill device than at the water inlet. The pressure regulator may include a reservoir upstream of the fill device. In some embodiments, the fill device may be the pressure regulator, such that the fill device may be configured to cause a pressure drop from upstream to downstream.

The first dish spray device may have at least one spray nozzle and the fill device may have at least one fill nozzle. The at least one fill nozzle may have a larger effective diameter than the at least one spray nozzle.

In some embodiments, the fill device may be configured to provide the water at a lower velocity than the first dish spray device. The first dish spray device may include one or more fixed spray devices attached to a wall of the washing chamber.

The first dish spray device may comprise at least one spray nozzle on a rotatable spray arm disposed adjacent the at least one dish rack. In some embodiments, the dishwasher may include a circulation valve configured to selectively couple the rotatable spray arm with one or both of the circulation assembly and the water inlet. The rotatable spray arm may be configured to selectively receive water from either one of the circulation pump and the water inlet.

Embodiments of the dishwasher may include a filter separating the sump from an upper portion of the wash chamber. The fill device may be disposed above the filter in the upper portion of the wash chamber. In some embodiments a filter may separate the sump from an upper portion of the wash chamber. The fill device may be at least partially disposed below the filter in the sump.

The dishwasher may include a filter separating the sump from an upper portion of the wash chamber, a filter spray device in the wash chamber oriented towards the filter for spraying water onto the filter; and a filter spray conduit fluidly connecting the water inlet to the filter spray device for supplying water from the water inlet to the filter spray device. The one or more valves may be configured to selectively fluidly connect the water inlet to the filter spray conduit. In some embodiments, the first dish spray device may define an atomizing nozzle.

The first dish spray conduit may include an in-line additive assembly configured to apply an additive to the water in the spray conduit. In some embodiments, the first dish spray conduit may include an in-line heater upstream of the additive assembly. One of the one or more valves may be a temperature-sensitive valve disposed between the in-line heater and the additive assembly for selectively directing water to the additive assembly when the water is above a predefined threshold temperature.

Embodiments of the dishwasher may further include a second dish spray device in the wash chamber oriented towards the at least one dish rack for spraying water onto the dishes; a second dish spray conduit having fluidly connecting the second dish spray conduit with the second dish spray device; and an additive assembly configured to apply an additive to the water in the second dish spray conduit.

In some other embodiments detailed herein, a method for filling a dishwasher may be provided. The dishwasher may include a wash chamber comprising a sump disposed proximate a lower end of the wash chamber; a circulation assembly connected to the sump; a dish rack positioned within the wash chamber for receiving dishes for washing; a water inlet configured to connect the dishwasher to a water source; a dish spray conduit fluidly connecting the water inlet with a first dish spray device located in the wash chamber and oriented towards the dish rack for spraying water onto the dishes; a fill conduit fluidly connecting the water inlet with a fill device located in the wash chamber for providing water to the sump; one or more valves configured to selectively fluidly connect the water inlet to one or both of the dish spray conduit and the fill conduit and direct water from the water inlet to one or both of the first dish spray device and the fill device. The method may include receiving a fill indication; in response to the fill indication, filling the wash chamber with water by opening one of the one or more valves to direct water from the water inlet to the dish spray conduit, such that water enters the wash chamber through the first dish spray device and is sprayed onto the dishes; receiving a full indication; and may include, in response to the full indication, closing the one of the one or more valves to cease filling the wash chamber.

In some embodiments, the indication to fill the wash chamber may indicate that the fill segment defines a wash fill segment, such that the one or more valves may be configured to direct water to the dish spray conduit during the wash fill segment.

The indication to fill the wash chamber may indicate that the fill segment includes a sump fill segment, and the one or more valves may further direct water to at least the fill conduit.

Some embodiments of the method may include detecting a filter clogging condition in a filter disposed between the sump and an upper portion of the wash chamber; closing, via the one or more valves, the dish spray conduit; and directing water to the fill conduit.

In some embodiments, the dishwasher may include a filter spray device in one of the wash chamber and the sump oriented toward the filter for spraying the filter, and a filter spray conduit fluidly connecting the water inlet to the filter spray device. In such embodiments, the method may include detecting a filter clogging condition in a filter disposed between the sump and an upper portion of the wash chamber; and in response to detecting a clogging condition, cleaning the filter by, via the one or more valves, directing water to the filter spray device and spraying the filter.

In some embodiments, the method may include detecting a filter clogging condition in a filter disposed between the sump and an upper portion of the wash chamber; and in response to detecting a clogging condition, cleaning the filter by pulsing a circulation pump of the circulation assembly to provide washing liquid to one or more spray arms.

Embodiments of the method may include directing, via the one or more valves, water to the fill device, and reducing the pressure of the water in the fill conduit. Reducing the pressure of the water in the fill conduit may include reducing the pressure of the water by directing the water into a reservoir.

In some embodiments, the dish spray conduit may include an in-line additive assembly. In such embodiments, the method may include adding an additive to the water in the dish spray conduit. The dish spray conduit may include an in-line heater, and embodiments of the method may comprise heating the water in the dish spray conduit. In some embodiments, one of the one or more valves may be a temperature-sensitive valve. The temperature-sensitive valve may be disposed between the in-line heater and the additive assembly, such that the temperature-sensitive valve may be configured to direct water to the additive assembly when the water is above a predefined threshold temperature.

Some embodiments of the method may include circulating water in the wash chamber via a circulation assembly during a circulation portion, and directing the water to the first dish spray device may comprise directing the water onto the one or more dishes for washing during the circulation portion.

BRIEF DESCRIPTION OF THE DRAWINGS

Figure 1:
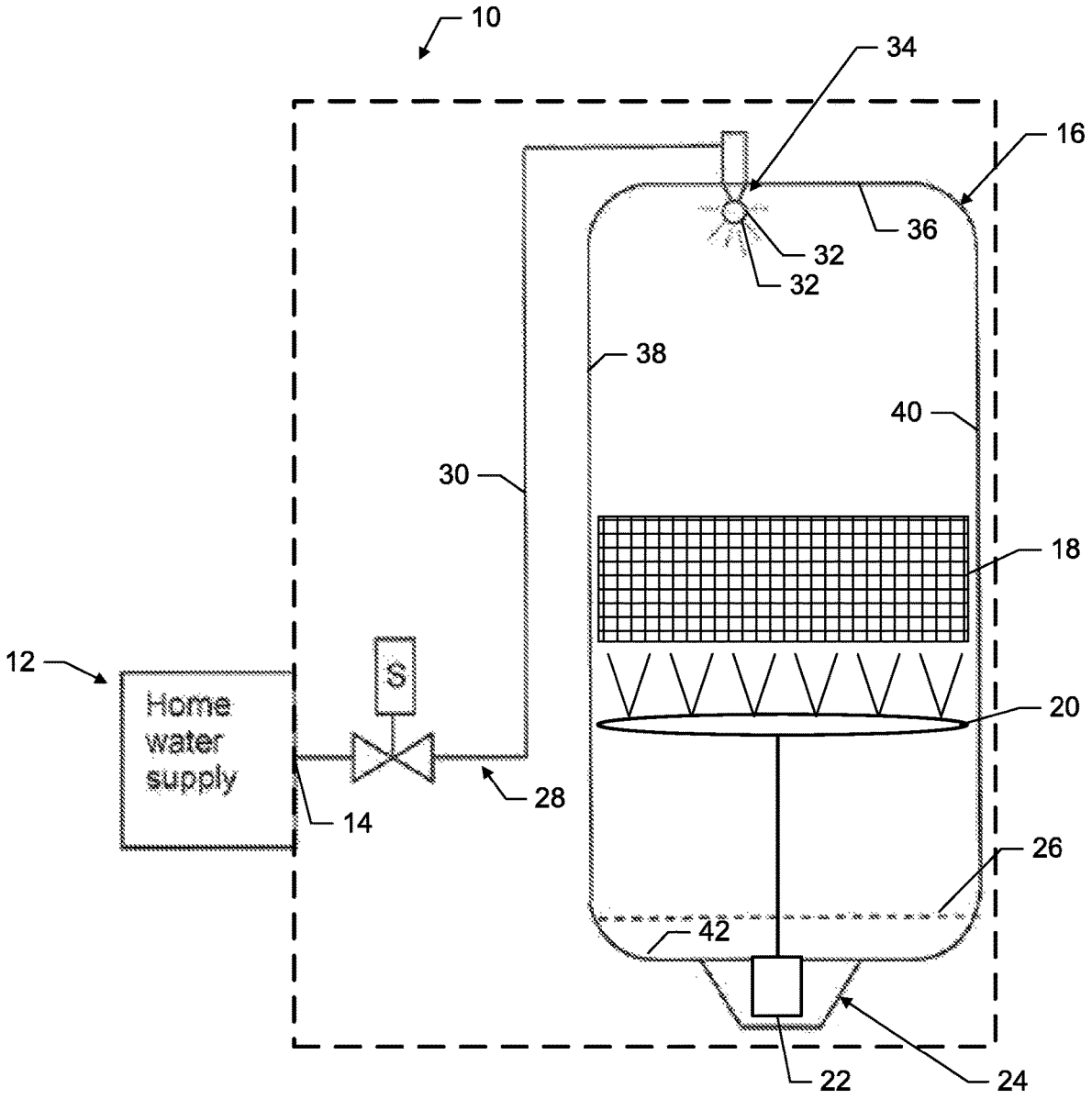
Figure 2:
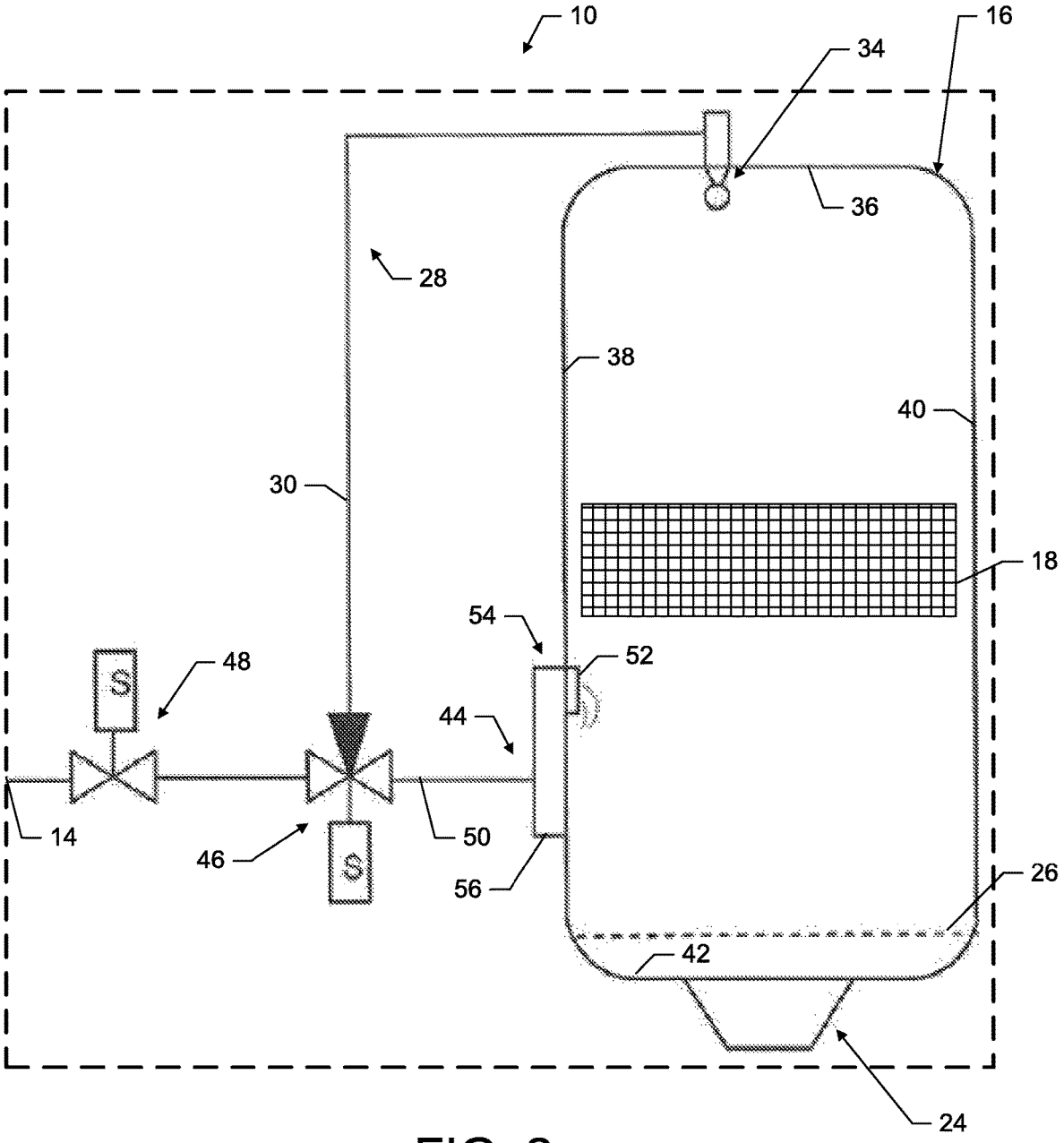
Figure 3:
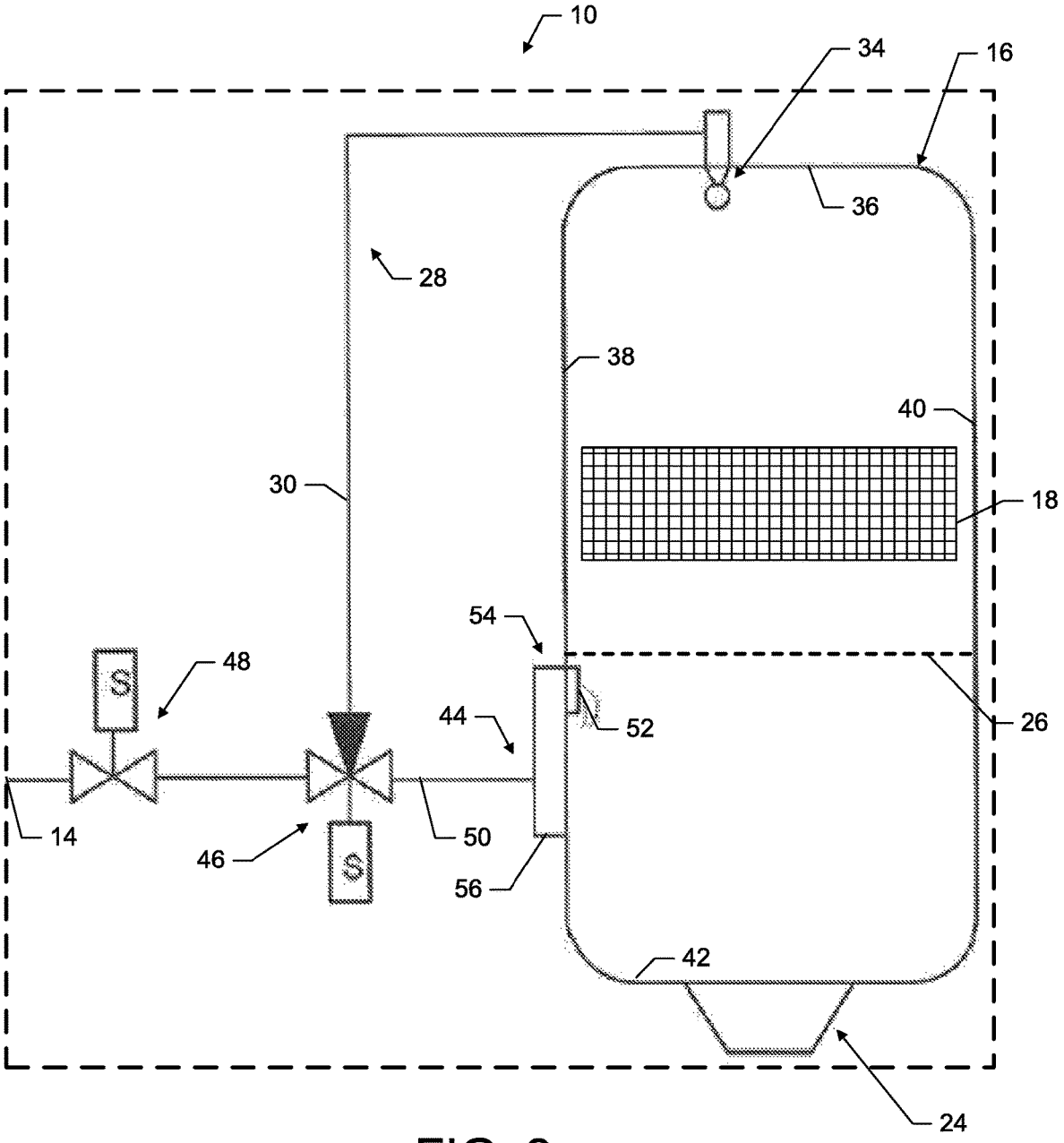
Figure 4:
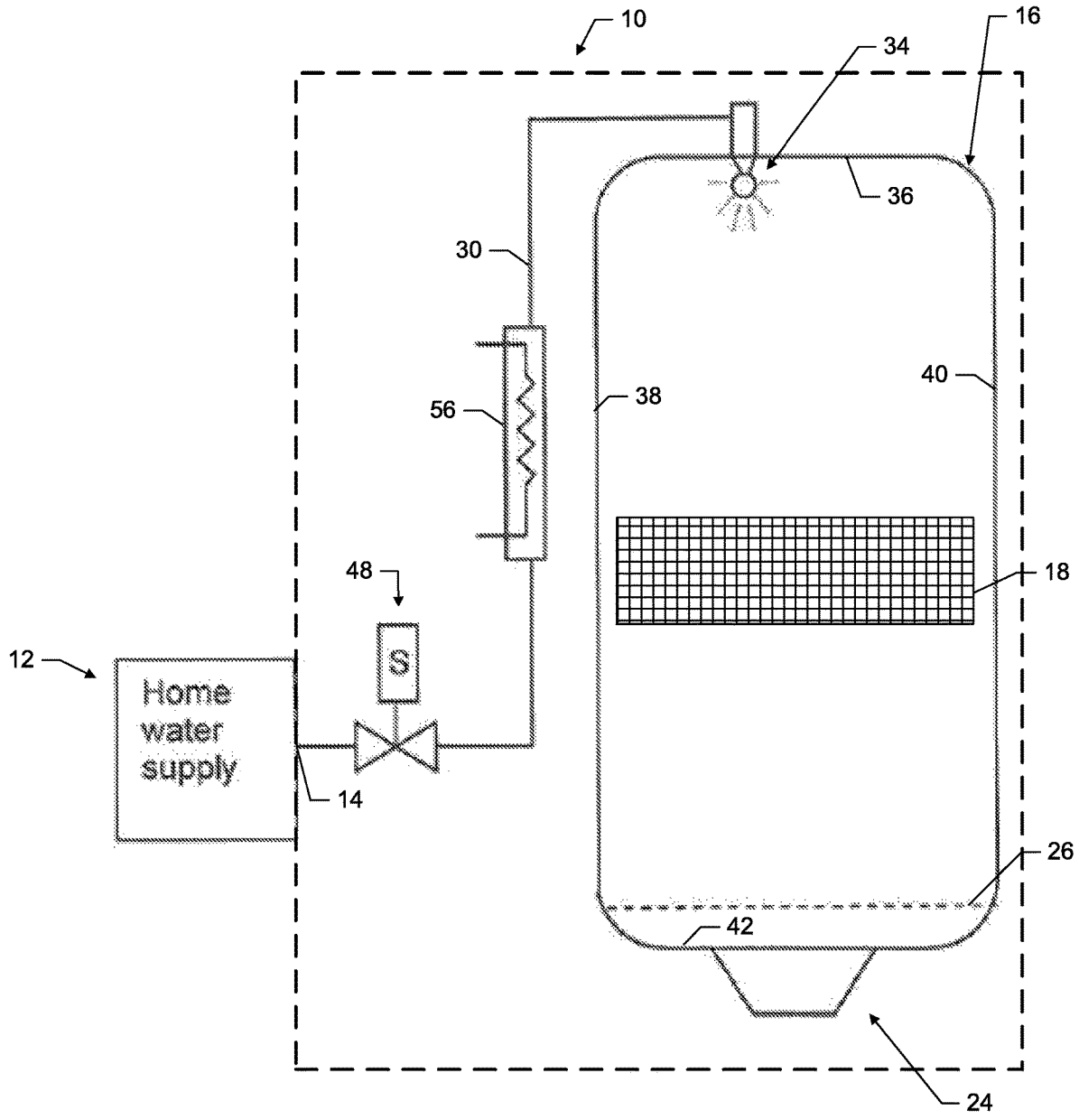
Figure 5:
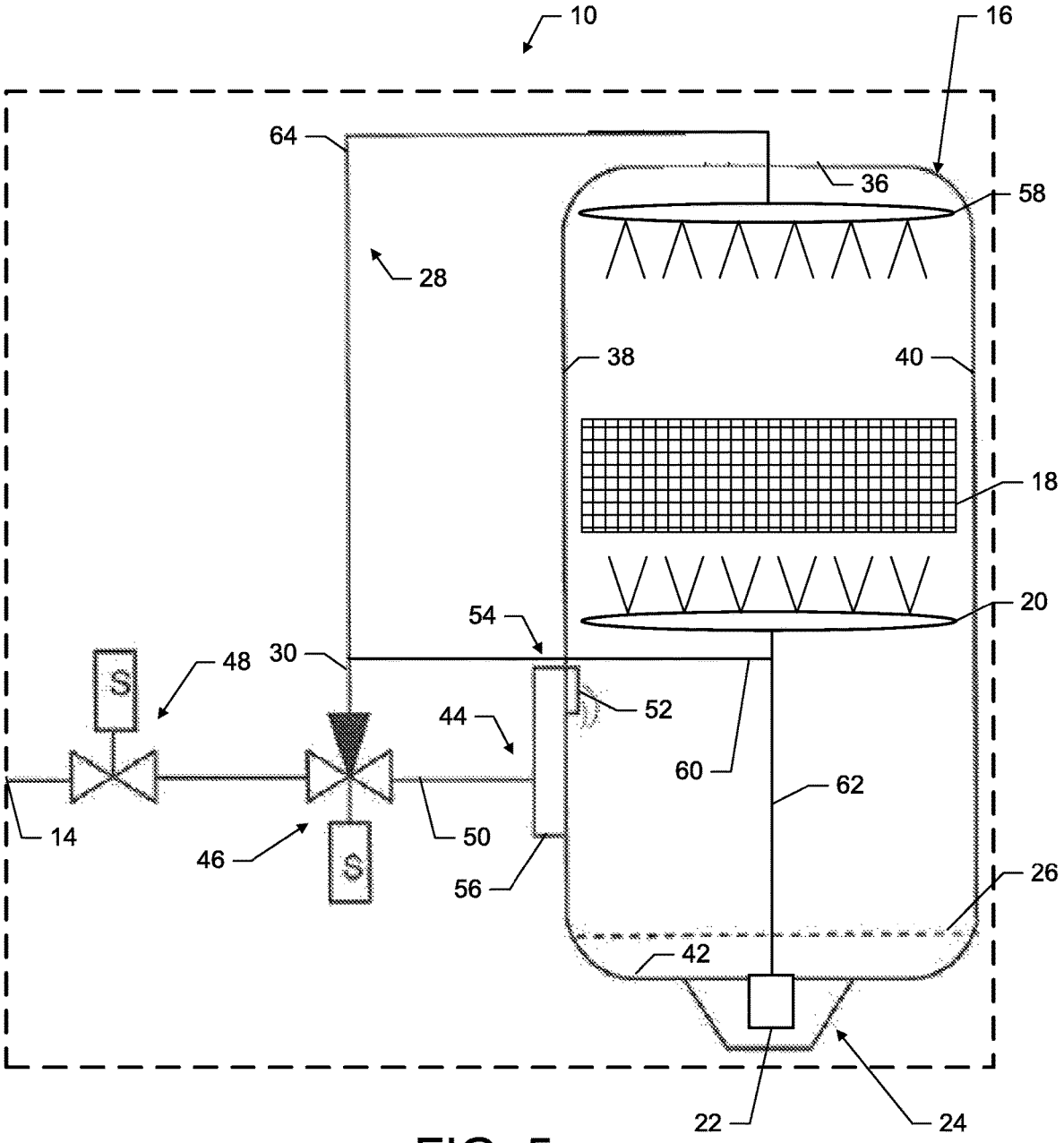
Figure 6:
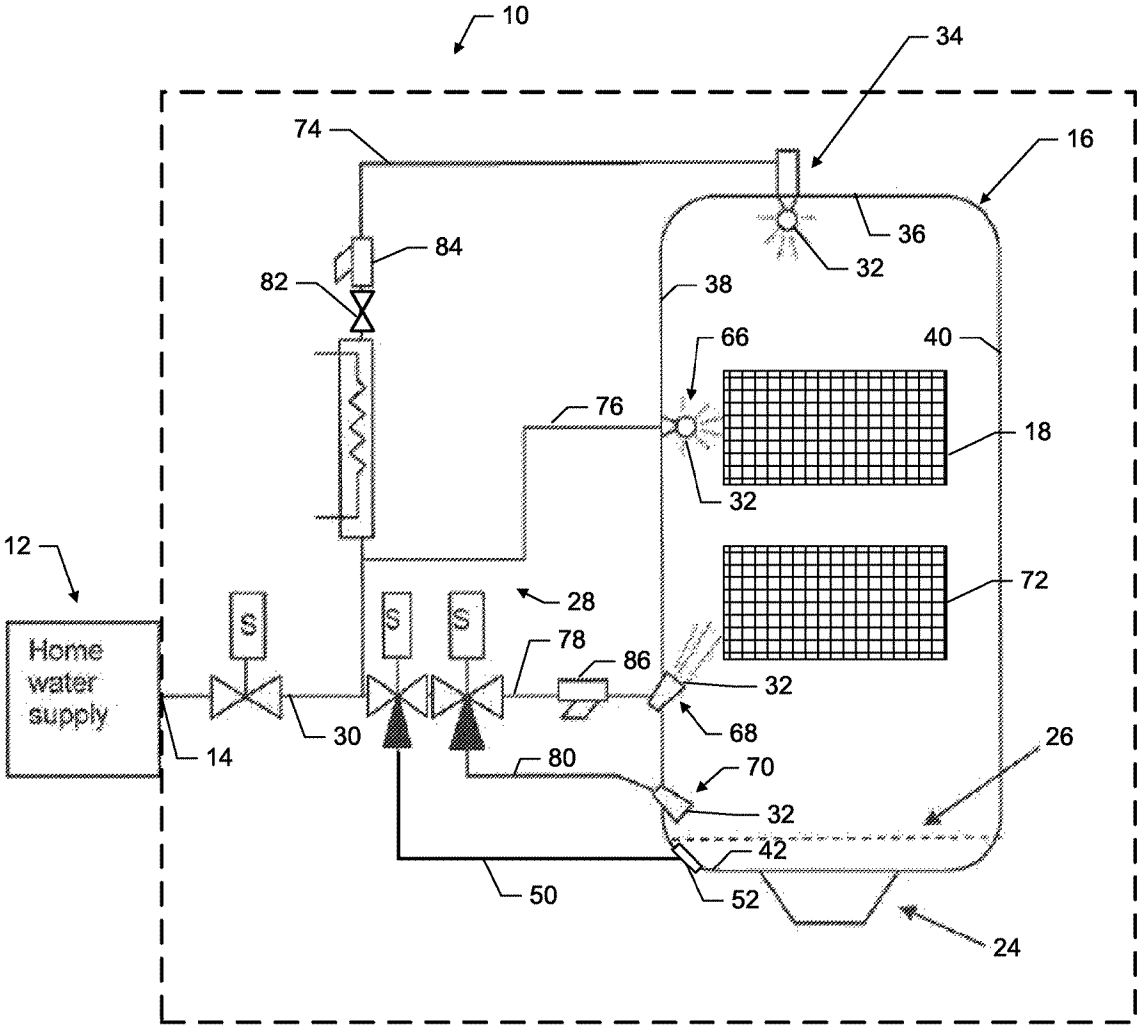
Figure 7:
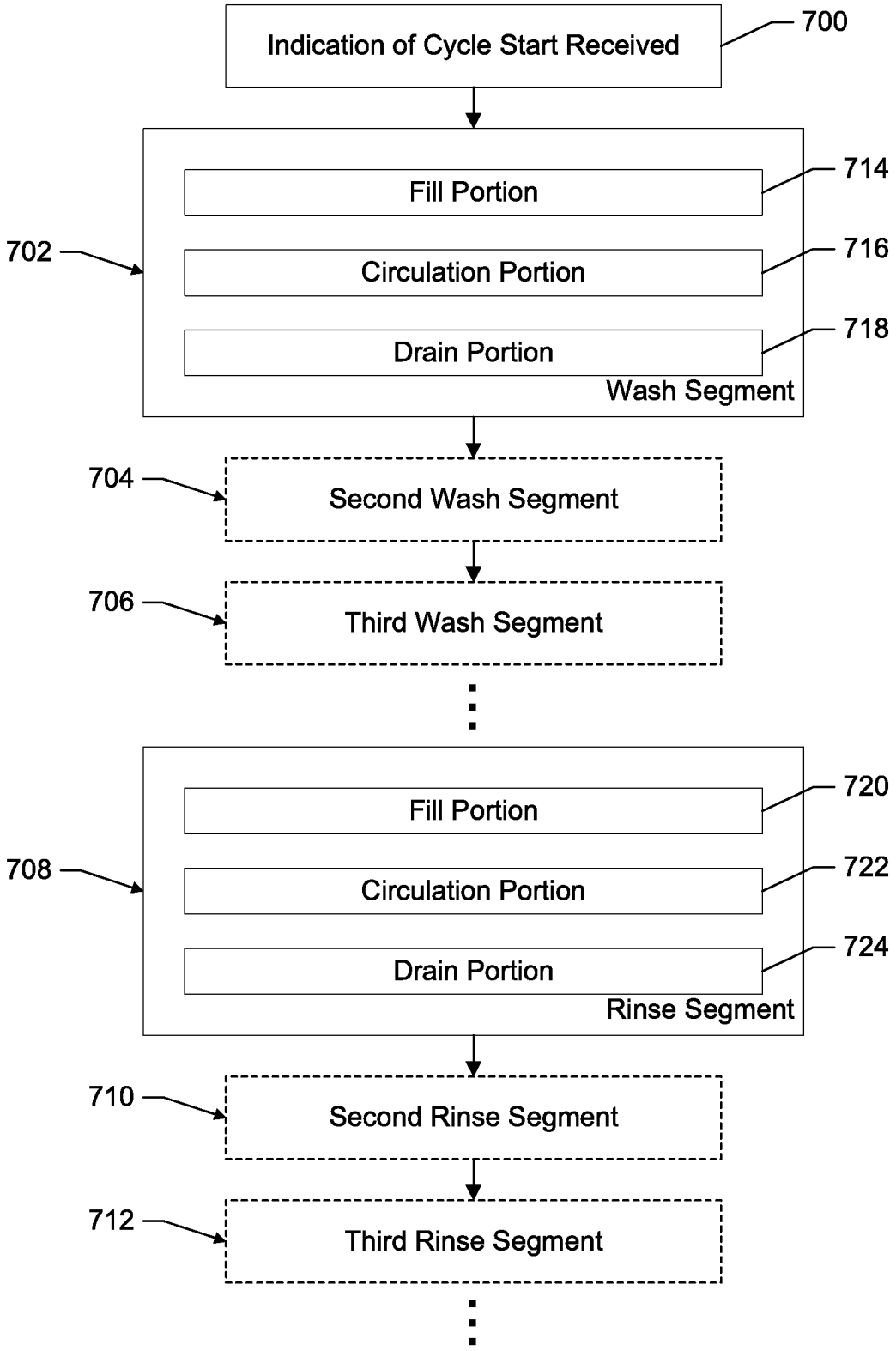
Figure 8:
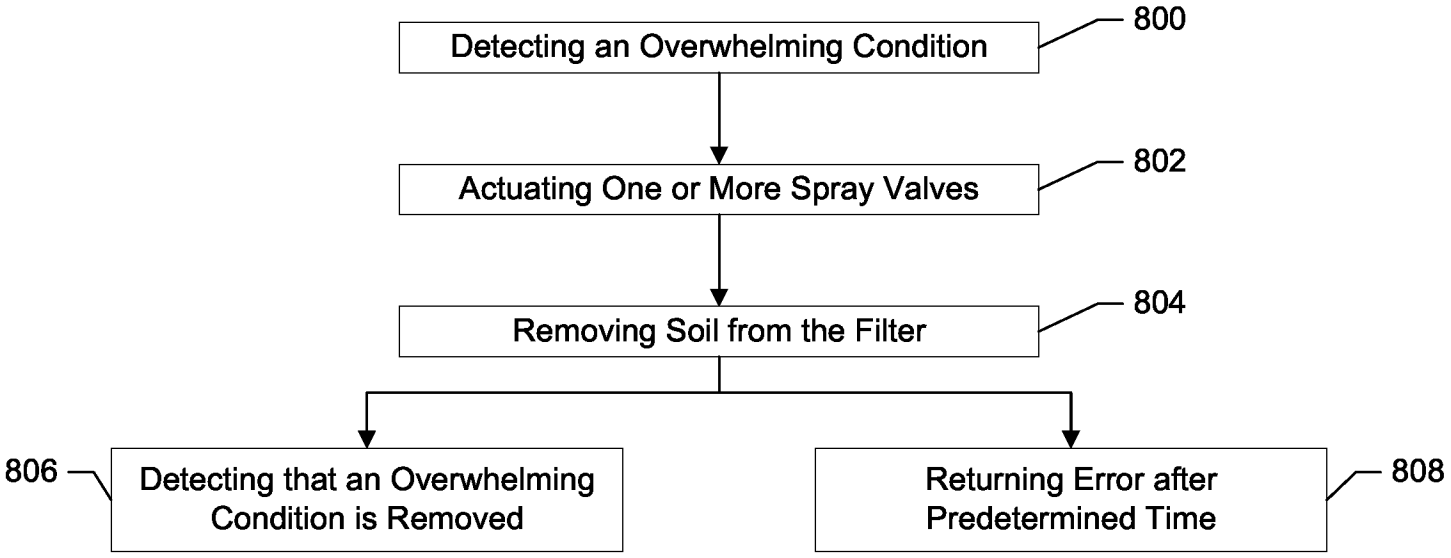
Figure 9:
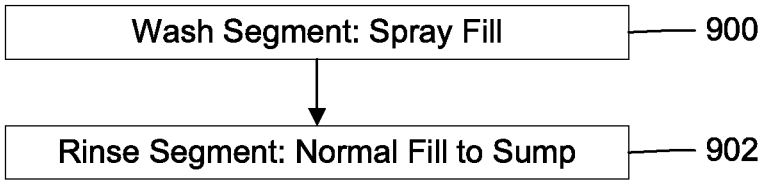
Figure 10:
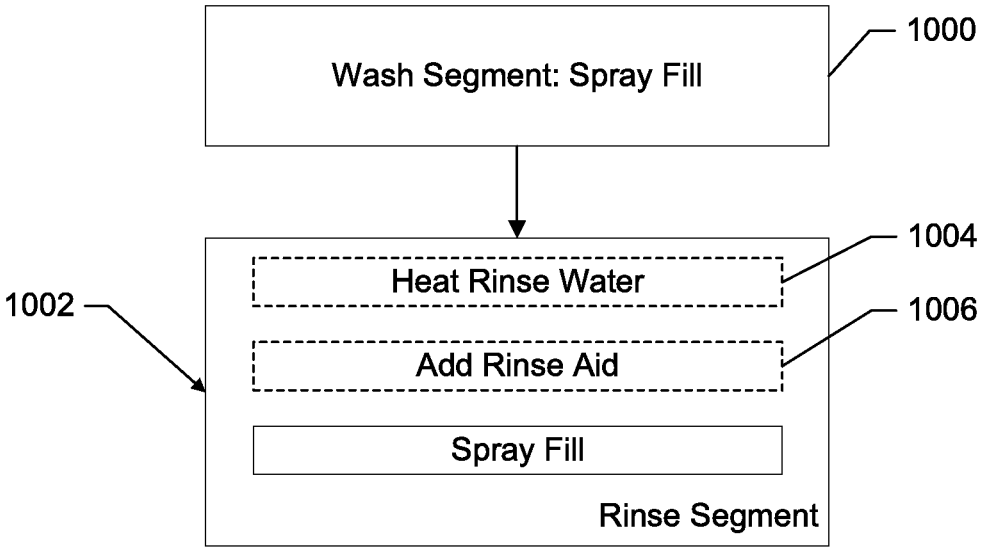
Figure 11:
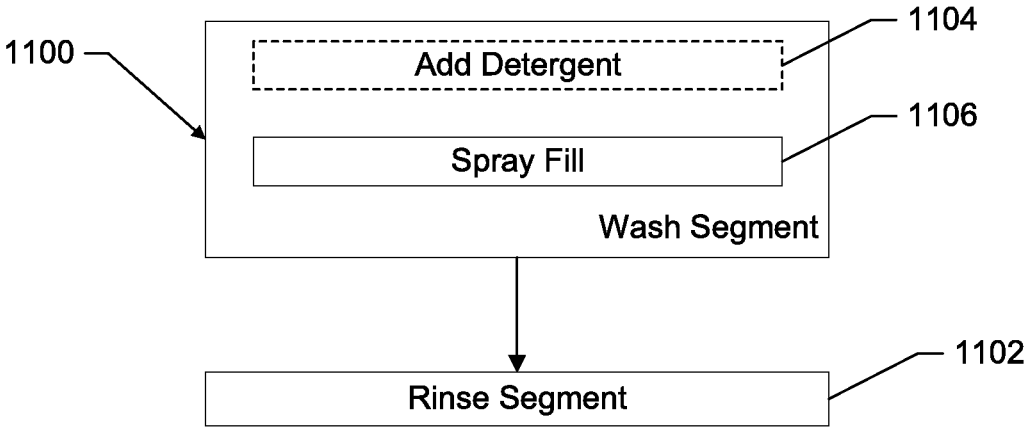

Having thus described the invention in general terms, reference will now be made to the accompanying drawings, which are not necessarily drawn to scale, and wherein:

FIG. 1 shows a dishwasher having a spray-fill system according to some embodiments discussed herein;

FIG. 2 shows a dishwasher having a spray-fill system and a sump-fill system according to some embodiments discussed herein;

FIG. 3 shows a dishwasher having a spray-fill system and a sump-fill system according to some embodiments discussed herein;

FIG. 4 shows a dishwasher having a spray-fill system with a heater according to some embodiments discussed herein;

FIG. 5 shows a dishwasher with spray arms according to some embodiments discussed herein;

FIG. 6 shows a dishwasher having a spray-fill system with additive systems according to some embodiments discussed herein;

FIG. 7 shows an example dishwashing cycle according to some embodiments discussed herein;

FIG. 8 shows an example filter cleaning method according to some embodiments discussed herein;

FIG. 9 shows an example dishwashing cycle using a combination spray-fill and sump fill according to some embodiments discussed herein;

FIG. 10 shows an example dishwashing cycle using spray-fill for wash and rinse segments according to some embodiments discussed herein; and FIG. 11 shows another example dishwashing cycle using spray-fill according to some embodiments discussed herein.

DETAILED DESCRIPTION

Exemplary embodiments of the present invention now will be described more fully hereinafter with reference to the accompanying drawings, in which some, but not all embodiments of the invention are shown. Indeed, the invention may be embodied in many different forms and should not be construed as limited to the exemplary embodiments set forth herein; rather, these embodiments are provided so that this disclosure will satisfy applicable legal requirements. Like reference numerals refer to like elements throughout.

Time and energy efficiency may be limiting factors of dishwasher performance. In traditional dishwashers, forty to eighty seconds of a fill segment may be used to fill the dishwasher with no water being used to clean the dishes. In dishwashers using five or more fill segments during the course of a wash cycle, this fill process could add five minutes or more to a wash cycle. This is five minutes of time when no dishes are being washed. The additional minutes of fill time substantially increases the overall length of the cycles, and users often associate the overall length of a wash cycle with the quality of a dishwasher.

In addition, dishwasher circulation pumps deliver washing fluid to the spray arms at pressure of approximately 2 to 5 psig, while home water supplies operate at much higher pressures, such as between 30 and 110 psig.

Example Spray System and Hardware

Some embodiments described herein include a dishwasher having a spray-fill system. The spray-fill system may, during one or more fill segments of a wash cycle, direct water from a home water supply directly onto dishes in a dish rack via one or more openings (e.g., nozzles) positioned around the wash chamber of the dishwasher. During an example spray fill, water from the home water supply may soak the dishes and remove debris while filling the dishwasher for the wash cycle, which starts the soaking process earlier in the wash cycle and combines the washing and filling functions of the wash cycle. In some embodiments, a valve (e.g., a solenoid valve) may selectively direct water from the home water supply onto the dishes in a spray configuration or directly to the circulation pump in a fill configuration. As described in further detail below, some embodiments of the spray-fill may include heating and supplying additives to the fresh water during certain portions of the wash cycle to improve the efficiency of the dishwasher.

With reference to FIG. 1, a dishwasher 10 is shown connected to a home water supply 12 via a water inlet 14. The dishwasher 10 may include a wash chamber 16, which may be enclosed by a door (not pictured) of the dishwasher to allow the user to access the dishes therein. The dishwasher 10 may further include at least one dish rack 18 for supporting the dishes for washing and at least one spray arm 20 connected to a circulation assembly, including a circulation pump 22, to recirculate washing liquid onto the dishes during a circulation portion of the wash and rinse segments of a wash cycle. The wash chamber 16 may include a sump 24 at a lower end thereof. The circulation pump 22 may be attached to the sump to recirculate the washing liquid as it collects in the sump, and a filter 26 may be disposed in the wash chamber to collect soil from the dishes before they are recirculated. In addition, the dishwasher may include a drain connected to the sump and may include a drain pump for removing washing liquid from the wash chamber.

The dishwasher 10 may include a spray-fill system 28, which directs the water from the water inlet 14 onto the dishes in the dish rack 18. The spray-fill system 28 may include a spray conduit 30, to receive the water from the inlet 14. The spray conduit may include spray devices (e.g., spray device 34) having one or more spray nozzles 32 to spray the water into the wash chamber 16. In some embodiments, at least a portion of the spray devices (e.g., spray devices 34) may be either fixedly attached within the wash chamber 16 or included as part of a rotating spray arm, as detailed below. In some embodiments, the spray device 34 may be attached to a wall 36, 38, 40, 42 of the wash chamber, and the nozzles 32 may be oriented towards the dish rack 18 to direct the water onto the dishes. The spray device 34 may include an atomizing nozzle and may define any nozzle shape or configuration, such as a simple-orifice nozzle, conical nozzle, rotating spray nozzle, or other type of nozzle known in the art. For example, one or more misting nozzles, rotating nozzles, or high-impact jet nozzles may be used. Misting nozzles may aid with soaking and softening soils on dishes, while rotating nozzles may be used for even coverage, and jet nozzles or rotating jet nozzles may address specific cleaning zones for coverage and to remove soil from the dishes. In some embodiments, the one or more nozzles 32 may be holes in one or more walls 36, 38, 40, 42 of the wash chamber 16. Any other desired type or configuration of spray devices and nozzles may be used in addition to or instead of the spray devices detailed herein.

Turning the FIG. 2, the dishwasher 10 may include a fill system 44 that directs the fresh water from the inlet 14 indirectly or directly into the sump 24 of the wash chamber 16 without spraying the dish rack. The dishwasher 10 may include one or more valves (e.g., valve 46) for directing the flow to one or both of the spray system 28 and the fill system 44 or for shutting off the flow of water from the house water supply (e.g., valve 48). The fill system 44 may include a fill conduit 50 having one or more fill nozzles 52 to deliver the water to the wash chamber 16.

In some embodiments, the fill conduit 50 may include a pressure regulator (e.g., reservoir 56) that may reduce the pressure of the water from the home water supply before entering the wash chamber 16. The pressure regulator may include other flow control devices for reducing the pressure of the water. For example, the fill nozzles 52 may have an effective diameter that is sufficiently large to reduce the velocity of the water leaving the nozzles. In this context, the effective diameter refers to the effective opening size of the combined nozzles (e.g., two smaller holes may be substituted for one large hole).

In some embodiments, the pressure regulator may be part of a fill device 54, which includes the fill nozzles 52. In some other embodiments, a regulator may be positioned upstream of the nozzles 52 in the fill conduit 50 to restrict the flow of water. In embodiments including a reservoir 56, the water from the inlet 14 may first enter the reservoir to reduce the pressure of the water. For example, equalize with the atmosphere in the wash chamber 16 before flowing out the nozzles 52.

In some embodiments, the spray nozzles 32 may include a smaller effective diameter than the fill nozzles 52. As detailed above, the spray nozzles 32 may spray the water towards the dish rack 18, and the spray nozzles may spray the water with a higher velocity than the fill nozzles 52. The velocity of the water in the spray device may be controlled by the pressure of the house water supply, while the reduced pressure of the fill device allows a lower velocity flow to the sump 24.

While the fill nozzles 52 may allow the water to fill the wash chamber 16 without the water impinging the dish rack 18, this type of flow does not require the dish rack 18 to remain dry and may include inadvertent or de-minimis splashing onto the rack.

Similar to the spray nozzles 32, the fill nozzles 52 may be positioned in a wall 36, 38, 40, 42, fill device 54, or other spray device to direct the water from the fill conduit 50 into the wash chamber 16. In some embodiments, the fill nozzles 52 may be positioned above the filter 26 as shown in FIG. 2. In the embodiment shown in FIG. 2, the one or more fill nozzles 52 may provide fresh water to the circulation pump 22 by directing the water down the side wall (e.g., wall 38) of the wash chamber 16 through the filter 26 and into the sump 24.

With reference to FIG. 3, in some embodiments, the fill nozzles 52 may be positioned beneath the filter 26, such that the fresh water may be directly supplied to the sump 24 and circulation pump 22 without first passing through the filter. In some further embodiments, the fill nozzle may be adjacent the circulation pump. In some embodiments, multiple fill nozzles may be used above and/or below the filter. As detailed below, the fill nozzles 52 may be utilized for certain segments of the wash cycle or for other cleaning or filling purposes.

Turning to FIG. 4, in some embodiments, the dishwasher 10 may include a heater 56 along one or more spray conduits (e.g., spray conduit 30). As detailed below, the heater 56 may be used to heat the water during spray filling in one or more wash segments and/or rinse segments. The heater 56 may be an in-line heater to heat the water under pressure as it travels to the spray nozzles 32. The dishwasher 10 may additionally or alternatively include a heater in the sump for heating the liquid prior to circulation. In some embodiments, the fill conduit 50 may additionally or alternatively include a heater.

With reference to FIG. 5, in some embodiments, the spray fill system may use one or more rotating spray arms (e.g., spray arms 20, 58), having one or more nozzles, to direct the water from the inlet 14 onto the dishes. In some embodiments, the spray fill system may include a separate spray arm (e.g., spray arm 58 in FIG. 5) connected to the spray conduit 30 for filling the wash chamber 16, which spray arm may not be connected to the circulation pump 22. In some embodiments, a spray arm (e.g., spray arm 20 in FIG. 5) may be connected to both the circulation pump 22 and the inlet 14 via conduits 60, 62 upstream of the wash chamber 16 as a combined spray arm, and a circulation valve may allow selective coupling of the spray arm to one or both the circulation pump and inlet (e.g., for selectively supplying water through the spray arm from either source in isolation or from both sources in combination during respective fill or circulation portions of a wash segment). In a combined spray arm (e.g., spray arm 20 in FIG. 5), one or more valves (e.g., one-way valves) may prevent backflow in the conduits 60, 62 towards the inlet 14 or circulation pump 22 respectively. In some embodiments, one spray arm, two spray arms, more than two spray arms, or any combination thereof may be combined spray arms or separate spray arms.

In some embodiments, multiple spray arms may be used in either or both a separate spray configuration and a combined spray arm configuration. For example, in the embodiment shown in FIG. 5, an upper spray conduit 64 connects to an upper spray arm 58, but the upper spray arm 58 is not connected to the circulation pump. In the embodiment of FIG. 5, the lower spray arm 20 is connected to both the inlet 14 and circulation pump 22 as detailed above. In some embodiments, one valve (e.g., valve 46 in FIG. 5) may connect all of the spray nozzles to the inlet 14. In some other embodiments, individual valves or a multi-way valve may control any subset of the spray nozzles separately. For example, in FIG. 5, an additional valve may be used to supply fresh water to the upper spray arm 58 and lower supply arm 20 separately. In some further embodiments, the circulation pump 22 may direct water to one spray arm (e.g., the lower spray arm 20 in FIG. 5) while the spray conduit (e.g., upper spray conduit 64 in FIG. 5) directs fresh water to another spray arm (e.g., upper spray arm 58 in FIG. 5). The circulation pump and spray fill system may direct both recirculated washing liquid and fresh water to the same spray arm simultaneously.

With reference to FIG. 6, an embodiment of a spray fill system is shown having multiple spray devices and integrated systems. As detailed above, multiple spray nozzles 32 may be positioned at any location in the wash chamber 16. In some embodiments, the spray nozzles 32 may be arranged in multiple spray devices (e.g., spray devices 34, 66, 68, 70 in FIG. 6) in the spray fill system. The spray devices may be oriented in any necessary direction. For example, with reference to FIG. 6, a first spray device 34 is shown oriented towards the tops of two dish racks 18, 72. Moreover, in the embodiment of FIG. 6, a second spray device 66 is shown oriented towards a side of the top dish rack 18. Similarly, a third spray device 68 is shown oriented towards a bottom corner of the bottom dish rack 72. In some embodiments, a spray device may be attached to one or more of the dish racks. In some embodiments, the dishwasher 10 may include one or more fill nozzles 52 in any of the configurations as detailed herein (e.g., with respect to FIGS. 2-3). For example, FIG. 6 shows a fill nozzle 52 disposed below the filter 26 and connected to the water inlet 14 via a fill conduit 50 and several valves.

In some embodiments, one or more spray devices 70 of the spray fill system may be oriented towards the filter 26. In such embodiments, the spray devices 70 oriented towards the filter may be used to clear the filter 26, and may also be used to at least partially fill the wash chamber 16. These spray devices 70 may operate in the spray-fill system in substantially the same manner as the dish-rack-oriented spray devices and may be selectively actuated by one or more valves as needed to clean the filter 26, as detailed below. In some embodiments, the filter-cleaning spray devices 70 may be positioned above or below the filter 26.

In some embodiments, the spray devices may be directional, such that they concentrate spray onto a particular area or direction, or wide, such that they deliver water onto a wide (e.g., 180 or 360 degree area) section of the wash chamber 16. For example, with reference to FIG. 6, spray devices 68 and 70 are more directional in nature, with the spray nozzles 32 being generally pointed in the same direction. In contrast, spray devices 34 and 66 include spray nozzles 32 oriented in multiple directions to create a broader spray. Similarly, one or more spray devices may be configured to atomize the water in a finer and/or broader pattern, while one or more spray devices may be configured to spray the water directionally. Any type of spray pattern or spray concentration may be used in different configurations of spray devices as needed to soak, clean, and/or rinse the dishes. The spray devices and spray nozzles detailed herein may be used in any combination or sequence to provide water in the desired concentrations to the desired areas of the wash chamber 16.

With continuing reference to FIG. 6, a heater 56 is shown along a first spray conduit 74 connected to a first spray device 34. As detailed above, with respect to FIG. 4, the heater 56 may heat the fresh water before it is sprayed into the wash chamber 16. In some embodiments, the heater 56 may be disposed upstream of a bi-metallic or memory shape valve 82 to selectively allow fresh water into the wash chamber 16 when the water temperature reaches a predetermined threshold value. As detailed above, one or more heaters may be applied to any spray conduits (e.g., conduits 74, 76, 78, or 80 in FIG. 6) or directly within the wash chamber.

FIG. 6 also shows example additive assemblies (e.g., additive assemblies 84, 86). The additive assemblies 84, 86 may introduce wash or rinse aids into the fresh water to improve dishwasher efficiency. One or more additive assemblies (e.g., additive assemblies 84, 86) may be connected to one or more spray conduits (e.g., conduits 74, 76, 78, or 80 in FIG. 6) to deliver a rinse aid, detergent, descaling substance or other desired additives to the fresh water. For example, the first spray conduit 74 in FIG. 6 includes a rinse aid 84 dispenser for delivering rinse aid to the fresh water before the water is sprayed from the spray device 34. Similarly, third conduit 78 of FIG. 6 includes a detergent dispenser 86 for adding detergent to the spray-fill water for spraying onto the dishes from spray device 68.

In some embodiments, one or more spray devices may be dedicated to a particular additive, such that the spray device is only activated when the additive is to be administered. For example, spray device 68 in FIG. 6 may be activated only when detergent is to be added to the dishes. Alternatively, the additive systems may include a by-pass or regulator to allow the concentration of additive in the fresh water to be controlled. In such embodiments, the additive assembly may allow the additive to be selectively added while the spray device may be independently controlled to spray water with or without the additives. In some embodiments, multiple selectable additives may be included in one or more additive systems on the same conduit.

In addition, different additive systems may be used with spray devices that are designed and positioned in the wash chamber 16 to administer a particular additive. For example, in FIG. 6, if rinse aid should be sprayed onto the tops of the dishes to coat each dish, the rinse aid may be dispensed through a spray device 34 mounted near the top wall 36 of the wash chamber 16. Similarly, if detergent should be dispensed from below, or in a more concentrated spray, the detergent additive system 86 may be coupled with an upward-facing spray device (e.g., spray device 68 in FIG. 6) and/or a directional spray device, respectively.

Individual valves may be used to control each of the spray conduits separately, and any set or subset thereof may be controlled together with a single valve. Any order, configuration, and combination of spray devices and additional components may be used in a spray-fill system. For example, with reference to FIG. 6, the first spray conduit 74 includes a heater 56 temperature sensitive valve 82 and rinse aid dispenser 84. In such an embodiment, the rinse aid may be administered only when the valve opens at a predetermined temperature. Other combinations or sub combinations of these systems and devices may be used in the embodiments discussed herein.

Example Operation and Methods

As detailed herein, the spray-fill devices, systems, and methods described herein may be used to increase the cleaning efficiency of a dishwasher. In an example embodiment, with reference to FIG. 7, the user selects a wash cycle and instructs the dishwasher to begin 700. The dishwasher may fill the wash chamber to a predetermined level before the circulation system may operate without causing excess noise or wear to the pump. During this filling process, fresh water, optionally including one or more additives, may be introduced to the wash chamber via one or more spray devices (e.g., the spray device 34 shown in FIGS. 1-6, spray arm 58, 20 nozzles shown in FIG. 5, and/or spray devices 66, 68, and 70 shown in FIG. 6). In some embodiments, one or more spray nozzles 32 of the spray devices may be oriented towards at least one dish rack (e.g., dish rack 18 shown in FIGS. 1-6 and/or dish rack 72 shown in FIG. 6). In such embodiments, the fill process may be combined with a spraying and soaking process that begins cleaning the dishes in the rack(s) as soon as the wash cycle starts.

In an example wash cycle, with continued reference to FIG. 7, one or more wash segments 702, 704, 706 may be run, followed by one or more rinse segments 708, 710, 712. A given wash or rinse segment may include filling the wash chamber 714, 720, circulating the washing liquid 716, 722 with the circulation pump 22, and draining the soiled liquid 718, 724. In some embodiments, wash cycle may include one or more pre-wash segments followed by a main wash segment. During one or more wash segments, detergent and fresh water may be introduced to the wash chamber 16 during the fill and/or circulation portions using the systems and techniques detailed herein. The resulting washing liquid in the sump may be circulated to remove soil from the dishes. As detailed below, some embodiments include adding additional water from the spray-fill system during the circulation and cleaning portions of the wash segment. Any number of wash segments, such as one, two, three, or more wash segments, may be used to clean the dishes. In some embodiments, wash segments may be repeated, or the duration of individual wash segments may be prolonged, until a sensor determines that the dishes have been sufficiently cleaned.

The wash segments 702, 704, 706 may be followed by one or more rinse segments 708, 710, 712 of the wash cycle. The rinse segments 708, 710, 712 may remove detergent and remaining soils from the dishes with additional fresh water and/or circulation of washing liquid. Similarly, any number of rinse segments, or any length of rinse segment may be used, and may be controlled by a sensor, such as a turbidity sensor, which determines when the dishes are sufficiently cleaned. Embodiments of the spray-fill system described herein provide more, faster soaking and higher pressure spray, which may allow for faster and more efficient cleaning of dishes.

In some embodiments, the spray-fill system may additionally or alternatively be activated after the fill portion of a wash segment. For example, fresh water may be sprayed via one or more of the spray devices (e.g., the spray device 34 shown in FIGS. 1-6, spray arm 58, 20 nozzles shown in FIG. 5, and/or spray devices 66, 68, and 70 shown in FIG. 6) during the circulation of the wash liquid. The purity of the fresh water and the pressure of the spray-fill system may aid in cleaning the dishes by periodically spraying with a higher pressure than the circulation system and by displacing or diluting the soiled water with fresh water. The circulation system may be paused while the filling spray devices are active. In some alternative embodiments, the circulation system may continue to run while one or more spray devices are activated to provide additional cleaning power from the home water supply. In embodiments using the same spray devices (e.g., spray arms or separate spray devices) for both circulation and spray-fill, the circulation pump may alternate spraying with the spray-fill system or may simultaneously spray from both sources.

In some embodiments, the spray-fill system may be used to provide strong bursts of fresh water during the washing and/or rinsing segments. The bursts may be used one or more times in a wash segment to remove debris with the additional pressure of the home water supply and to add fresh water to the washing liquid. In some embodiments, the bursts may be triggered in rapid succession (e.g., multiple times per second). In some other embodiments, the bursts may be triggered more slowly (e.g., every few seconds, or for several seconds at a time). Additionally or alternatively, bursts of fresh water may be provided during the fill portion of the wash or rinse segment to further loosen soils. In some embodiments, the bursts may be used to add additives to the wash chamber during the circulation of the washing liquid in the washing or rinsing segments.

In some further embodiments, bursts may be triggered in specific spray devices. For example, in the embodiment shown in FIG. 6, the third spray device 68 may be independently triggered to deliver a directional spray to a specific zone (e.g., the underside) of the dish rack 72 and/or to deliver detergent to the dishes.

In some embodiments, bursts or continuous flow of water may be provided to one or more filter-cleaning spray devices to prevent the filter from becoming overwhelmed. During a spray-fill portion of the wash segment, enough soil may be removed from the dishes that the filter 26 becomes overwhelmed. In such embodiments, the circulation pump 22 may be unable to operate due to the lack of water in the sump 24, which may cause cavitation or loss of suction in the pump. In some embodiments, a dedicated spray device (e.g., spray device 70 in FIG. 6) may be oriented towards the filter 26 to provide fresh water to clean the filter. In such embodiments, with reference to FIG. 8, a sensor, such as an RPM sensor on the circulation pump, may detect an overwhelming condition in the filter 800 and open the one or more valves connecting the home water supply to the spray device oriented towards the filter 802 to remove the soil 804. The dedicated filter-cleaning spray device may remain active until the sensor detects normal motor operation 806 or may return an error if a threshold amount of time passes 808.

In some embodiments, the dishwasher 10 may pulse the circulation pump 22 during the filling process to keep the filter 26 free from debris. In such embodiments, the spray-fill system may direct fresh water onto the dishes, and the dishwasher may (e.g., via one or more controllers and control systems) periodically pulse or activate the circulation pump 22. The circulation pump 22 may spray water from the spray arms (e.g., arms 20, 58 shown in FIG. 5) to provide a substantial additional amount of water above the filter 26 for a short period of time to flush debris from the filter. In some embodiments, the spray arm may include one or more spray devices oriented toward the filter, which may assist with cleaning the filters during the circulation pump pulses. In embodiments using circulation pump 22 pulses, the dishwasher need not be filled completely to operate the pump for a short amount of time. Accordingly, the circulation pump may be operated in short bursts before the dishwasher filling has completed. The circulation pump 22 pulses detailed herein may be triggered either automatically after a predetermined amount of time, or may be triggered by sensors in the dishwasher (e.g., a water level sensor or turbidity sensor).

As detailed above, a drain pump, or the circulation pump, may be activated to drain the wash chamber 16 after a wash segment or rinse segment. In some embodiments, one or more spray devices may be activated during or before a drain portion of a wash or rinse segment to assist with the cleaning process. In particular, the fresh water from the spray devices may remove soil from the walls of the wash chamber 16 and the dishes that may have been circulating in the washing liquid. This may assist the drain phase by cleaning the interior of the wash chamber with fresh water, which may leave the dishwasher cleaner for future cycles.

As detailed above, the spray devices (e.g., the spray device 34 shown in FIGS. 1-6, spray arm 58, 20 nozzles shown in FIG. 5, and/or spray devices 66, 68, and 70 shown in FIG. 6) in the spray-fill system may be used to fill the wash chamber 16 during both wash segments and rinse segments (e.g., as shown in FIG. 10). In some embodiments, with reference to FIG. 9, the fill nozzles (e.g., fill nozzles 52 in FIGS. 2-3) may additionally or alternatively be used to supply fresh water to the sump. For example as shown in FIG. 9, in some embodiments, the spray devices may be used to direct water onto the dishes during the fill portion of a wash segment 900, and the fill nozzles (e.g., fill nozzles 52 in FIGS. 2-3) may be used to provide water directly to the sump 24 during the fill portion of a rinse segment 902. In some embodiments, the rinse water may be hotter than a standard home hot-water heater temperature, and may be additionally heated by the dishwasher heater in the sump. For example, a hot-water heater may reach approximately 120 degrees Fahrenheit while a dishwasher rinse cycle may operate between 130 and 160 degrees Fahrenheit. This temperature difference may improve drying and reduce spotting of the dishes. In such embodiments, the fill nozzles (e.g., fill nozzles 52 in FIGS. 2-3) may provide water directly to the sump 24 for additional heating before being circulated onto the dishes.

In some embodiments, as shown in FIGS. 4 and 6, and with reference to FIG. 10, a heater may be provided along one or more spray conduits (e.g., the first spray conduit 74). In such embodiments, the fresh rinse water may be heated to between 130 and 160 degrees Fahrenheit 1004 to improve the drying efficiency of the dishwasher using the heating devices detailed above during the rinse segment 1002. In such embodiments, the rinse segment 1002 may optionally use only spray devices having a heater for filling during the rinse segment (e.g., spray device 34 in FIGS. 4 and 6) 1008. In addition, as discussed above, one or more conduits (e.g., first spray conduit 74) may include a temperature sensitive valve 82 upstream of the heater 56 to allow fresh water into the wash chamber 16 when the water reaches a predetermined threshold temperature. In some embodiments, a predetermined amount of water may be slowly heated in the heater 56 during the dishwasher cycle until it reaches a predetermined temperature.

As detailed herein, detergent, rinse aid, or other additives may be applied to the fresh water in the spray-fill system to improve the efficiency of the dishwasher. For example, with reference to FIG. 10, rinse aid may be applied 1006 (e.g., using rinse aid dispenser 84 along a first spray conduit 74 shown in FIG. 6) during a rinse segment 1002 to reduce spotting. Similarly, with reference to FIG. 11, detergent may be applied 1104 (e.g., using detergent dispenser 86 along third spray conduit 78 shown in FIG. 6) during a wash segment 1100 to improve cleaning. In some embodiments, detergent may be applied during initial filling 1106 to provide longer soak time for the soil to be removed. In some other embodiments, detergent may be applied at the end of the fill portion of a wash segment in higher concentrations, to allow the detergent to remain on the dishes longer for a better cleaning effect.

In some embodiments, multiple spray devices may have separate purposes, as detailed above. For example, with reference to FIG. 6, the third spray device 68 may optionally be activated only when detergent is needed from the detergent dispenser 86. In some other embodiments, the additive dispensing systems may shut off completely and allow fresh water to flow without additives. Similarly, a dedicated spray device (e.g., first spray device 34 shown in FIG. 6) may be optionally activated only to distribute heated rinse water with rinse aid. Alternatively, the spray device 34 may be activated with or without the rinse aid and heating.

In some embodiments, spray devices may be activated simultaneously or in sequence depending on the desired performance. In some embodiments, multiple spray-fill devices may be activated to spray the fresh water onto the dishes from as many angles as possible. In some embodiments, such as a more general fill cycle, one or more wide spray devices may be used to fill the wash chamber 16. In some other embodiments, such as a heavy soil cycle, one or more directional spray devices may be used to target one or more high-intensity zones of the dish rack (e.g., dish racks 18, 72 shown in FIG. 6) during the fill portion of the wash segment. The spray devices of the spray-fill system may be activated by the one or more valves in sequence to ensure maximum pressure as each spray device is activated. In some other embodiments, more than one spray device may be simultaneously activated to increase the coverage of the dishes.

The embodiments of the dishwasher detailed herein may allow a user or automatic program to control the type of fill system, length of fill, and amount of water used in the fill portion of a wash segment or rinse segment. Any combination of the spray devices, systems, and additional components may be used in any configuration or sequence to produce the desired washing effect. In some embodiments, a user may input a desired efficiency or speed, and the dishwasher may determine an ideal set of operations, as detailed above, based upon these considerations. For example, more fresh water may be used during the wash and rinse segments and more detergent may be used during the wash segments if the user requires a fast wash; however, water may be recirculated more after the initial spray-fill or less heating may be used in the conduits if the user requires an efficient wash. In some embodiments, a user may be able to specifically request spray-fill or traditional-fill modes.

Many modifications and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. While some drawings and description may omit features described elsewhere for simplicity of explanation, it is understood that these features may nonetheless be present in any of the embodiments in any combination or configuration, as detailed above. Although specific terms are employed herein, they are used in a generic and descriptive sense only and not for purposes of limitation.

The invention claimed is:

1. A dishwasher comprising:

a wash chamber comprising a sump disposed proximate a lower end of the wash chamber and a circulation assembly connected to the sump;

at least one dish rack positionable within the wash chamber of the dishwasher, wherein the at least one dish rack is configured to receive dishes for washing;

a water inlet conduit configured to connect the dishwasher to a clean water source configured to supply clean water;

a first dish spray device in the wash chamber oriented towards the at least one dish rack for spraying clean water onto the dishes;

a dish spray conduit fluidly connecting the water inlet conduit to the first dish spray device for supplying clean water comprising liquid water from the water inlet conduit to the first spray device independent of the circulation assembly;

a fill device in the wash chamber configured to provide clean water to the wash chamber without impinging the dishes;

a fill conduit fluidly connecting the water inlet conduit to the fill device for supplying clean water from the water inlet conduit to the fill device; and one or more valves configured to allow the water inlet conduit to be selectively connected in one of at least three different configurations, wherein the one or more valves allow for selection among the at least three different configurations, wherein the at least three configurations comprise a first configuration in which the water inlet conduit is connected to just the dish spray conduit, wherein the at least three configurations comprise a second configuration in which the water inlet conduit is connected to just the fill conduit, and wherein the at least three configurations comprise a third configuration in which the water inlet conduit is connected to both the dish spray conduit and the fill conduit, and wherein in each of the first, second, and third configurations, the water inlet conduit is connected to one or both of the first dish spray device and the fill device independently of the circulation assembly.

2. The dishwasher according to claim 1, wherein the fill conduit further comprises a pressure regulator configured to reduce the pressure of the clean water from the water inlet conduit, such that the clean water has a lower pressure at the at least one fill device than at the water inlet conduit.

3. The dishwasher according to claim 2, wherein the pressure regulator comprises a reservoir upstream of the fill device.

4. The dishwasher according to claim 2, wherein the fill device is the pressure regulator, such that the fill device is configured to cause a pressure drop from upstream to downstream.

5. The dishwasher according to claim 1, wherein the first dish spray device has at least one spray nozzle and the fill device has at least one fill nozzle, wherein the at least one fill nozzle has a larger effective diameter than the at least one spray nozzle.

6. The dishwasher according to claim 1, wherein the fill device is configured to provide the clean water at a lower velocity than the first dish spray device.

7. The dishwasher according to claim 1, wherein the first dish spray device comprises one or more fixed spray devices attached to a wall of the washing chamber.

8. The dishwasher according to claim 1, wherein the first dish spray device comprises at least one spray nozzle on a rotatable spray arm disposed adjacent the at least one dish rack.

9. The dishwasher according to claim 8, further comprising a circulation valve configured to selectively couple the rotatable spray arm with one or both of the circulation assembly and the water inlet conduit, wherein the rotatable spray arm is configured to selectively receive either one of wash water from the circulation assembly and clean water from the water inlet conduit.

10. The dishwasher according to claim 1, further comprising a filter separating the sump from an upper portion of the wash chamber, wherein the fill device is disposed above the filter and in the upper portion of the wash chamber.

11. The dishwasher according to claim 1, further comprising a filter separating the sump from an upper portion of the wash chamber, wherein the fill device is at least partially disposed below the filter and at least partially disposed in the sump.

12. The dishwasher according to claim 1, further comprising:

a filter separating the sump from an upper portion of the wash chamber, a filter spray device in the wash chamber oriented towards the filter for spraying clean water onto the filter; and a filter spray conduit fluidly connecting the water inlet conduit to the filter spray device for supplying clean water from the water inlet conduit to the filter spray device, wherein the one or more valves are configured to selectively fluidly connect the water inlet conduit to the filter spray conduit.

13. The dishwasher according to claim 1, wherein the first dish spray device defines an atomizing nozzle.

14. The dishwasher according to claim 1, wherein the dish spray conduit further comprises an in-line additive assembly configured to apply an additive to the clean water in the dish spray conduit.

15. The dishwasher according to claim 14, wherein the dish spray conduit further comprises an in-line heater upstream of the additive assembly.

16. The dishwasher according to claim 15, wherein one of the one or more valves is a temperature-sensitive valve disposed between the in-line heater and the additive assembly for selectively directing clean water to the additive assembly when the clean water is above a predefined threshold temperature.

17. The dishwasher according to claim 1, further comprising:

a second dish spray device in the wash chamber oriented towards the at least one dish rack for spraying clean water onto the dishes;

a second dish spray conduit fluidly connecting the second dish spray conduit with the second dish spray device; and an additive assembly configured to apply an additive to the clean water in the second dish spray conduit.

18. The dishwasher according to claim 1, further comprising:

a circulation conduit fluidly connecting the first dish spray device to the circulation assembly; and a circulation valve configured for selectively supplying water through the first dish spray device from (a) the water inlet conduit, (b) the circulation assembly, or (c) both the water inlet conduit and the circulation assembly.

19. A dishwasher comprising:

a wash chamber comprising a sump disposed proximate a lower end of the wash chamber and a circulation assembly to the sump, wherein the circulation assembly comprises a pump;

at least one dish rack positionable within the wash chamber of the dishwasher, wherein the at least one dish rack is configured to receive dishes for washing;

a water inlet conduit configured to connect the dishwasher to a building clean water supply line at a building water supply line pressure;

a first dish spray device in the wash chamber oriented towards the at least one dish rack for spraying clean water onto the dishes;

a dish spray conduit fluidly connecting the water inlet conduit to the first dish spray device for supplying clean water from the water inlet conduit to the first spray device independent of the circulation assembly during a fill portion of a segment of a wash cycle; and a circulation conduit fluidly connecting the circulation assembly to the first dish spray device, wherein the building clean water supply line provides the clean water to the dishwasher at the building water supply line pressure, the dish spray conduit provides the clean water to the first dish spray device at a first pressure, and the first pressure is equal to or less than the building water supply line pressure;

a fill device in the wash chamber configured to provide clean water to the wash chamber without impinging the at least one dish rack or the dishes;

a fill conduit fluidly connecting the water inlet conduit to the fill device for supplying clean water from the water inlet conduit to the fill device, wherein the fill conduit comprises a pressure regulator configured to reduce a pressure of clean water from the water inlet conduit such that the fill device provides clean water at a second pressure that is less than the first pressure.

* * * * *